US007158081B2

(12) United States Patent
Pietig et al.

(10) Patent No.: US 7,158,081 B2
(45) Date of Patent: Jan. 2, 2007

(54) PHASED ARRAY ANTENNA

(75) Inventors: Rainer Pietig, Aachen (DE); Thomas Purr, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 173 days.

(21) Appl. No.: 10/480,663

(22) PCT Filed: Jun. 26, 2002

(86) PCT No.: PCT/IB02/02673

§ 371 (c)(1),
(2), (4) Date: Dec. 12, 2003

(87) PCT Pub. No.: WO03/003507

PCT Pub. Date: Jan. 9, 2003

(65) Prior Publication Data

US 2004/0164908 A1 Aug. 26, 2004

(30) Foreign Application Priority Data

Jun. 28, 2001 (DE) ..... 101 31 283

(51) Int. Cl.
*H01Q 1/38* (2006.01)

(52) U.S. Cl. ..... 343/700 MS; 343/770 MS; 343/846; 343/824; 343/853; 343/854

(58) Field of Classification Search ..... 343/700 MS, 343/824, 770–771, 767, 829–830, 833–835, 343/846–848, 853–854
See application file for complete search history.

(56) References Cited

U.S. PATENT DOCUMENTS

| | | | | |
|---|---|---|---|---|
| 4,173,019 | A * | 10/1979 | Williams | 343/700 MS |
| 4,755,821 | A * | 7/1988 | Itoh et al. | 343/700 MS |
| 4,866,451 | A * | 9/1989 | Chen | 343/700 MS |
| 5,382,959 | A * | 1/1995 | Pett et al. | 343/700 MS |
| 5,451,969 | A | 9/1995 | Toth et al. | |
| 5,661,494 | A * | 8/1997 | Bondyopadhyay | 343/700 MS |
| 6,081,234 | A | 6/2000 | Huang et al. | |
| 6,081,235 | A * | 6/2000 | Romanofsky et al. | 343/700 MS |
| 6,384,787 | B1 * | 5/2002 | Kim et al. | 347/700 MS |
| 6,441,787 | B1 * | 8/2002 | Richards et al. | 343/700 MS |

FOREIGN PATENT DOCUMENTS

| | | |
|---|---|---|
| EP | 0468413 A2 | 1/1992 |
| WO | WO 9917396 | 4/1999 |
| WO | WO9917396 | 4/1999 |

* cited by examiner

*Primary Examiner*—Hoang V. Nguyen
*Assistant Examiner*—Chuc Tran

(57) ABSTRACT

The invention relates to a miniaturized phased array antenna with a plurality of individual radiator elements (10xy), which antenna is designed in particular for use in the microwave frequency range. The antenna is characterized in particular that the radiator elements (10xy) are each aligned in dependence on their positions in the array so as to achieve a current distribution over the antenna as determined for a desired antenna characteristic. This renders it possible to realize a very strongly miniaturized antenna without the efficiency of the antenna being appreciably reduced.

8 Claims, 3 Drawing Sheets

PHASED ARRAY ANTENNA

This application is a 371 of PCT/IB02/02673, filed Jun. 26, 2002

The invention relates to a phased array antenna with a plurality of individual radiator elements, which antenna is provided in particular for use in the microwave range.

The wireless interlinking of several arrangements and devices in a radio network has become a key technology in the telecommunication industry, which has gained increasing importance in recent times also for consumer electronics. The known Bluetooth standard may be mentioned as an example of this. The wireless radio network interlinking offers a plurality of advantages over cable networks. Among these are a higher mobility and a simpler installation. A disadvantage is, however, that it has been possible to achieve only comparatively low data rates in comparison with glass fiber cable networks until now.

In order to utilize a radio network optimally, special access methods such as, for example, TDMA (Time Division Multiple Access), FDMA (Frequency Division Multiple Access), and CDMA (Code Division Multiple Access) have been developed, which have since established themselves in commercial cellular radio networks. These access methods use the frequency of the transmitted signal or the time sequence of signals as modulation parameters. A method that goes further than this, the SDMA (Space Division Multiple Access), uses the spatial characteristic of the transmitted signal as an additional modulation parameter. The signal-to-noise ratio of the transmission can be substantially improved in this manner, so that overall higher data rates can be achieved in a corresponding radio network. In addition, the transmission power may be reduced or the effective range may be increased owing to the directional radiation.

An essential precondition for realizing this modulation method, however, is the availability of antennas with a spatially directed radiation. Furthermore, these antennas should be as small as possible so that an integration into mobile devices such as, for example, mobile telephones is possible.

To achieve a directivity, so-called phased array antennas are often used. Such an antenna consists of a substantially regular arrangement of radiating elements. The amplitudes and phases of the currents in the radiating elements can be adjusted by means of a suitable supply network. The desired directional characteristic of the antenna is achieved through a corresponding choice of these parameters. Linearity effects as high as desired can indeed be generated thereby in theory, but in practical realizations there are limits. A directivity of approximately $L/\lambda$ can be achieved for a linear phased array antenna with a length L, and for a planar antenna of this type with a surface area A the directivity is of the order of approximately $A/\lambda^2$, where $\lambda$ denotes the wavelength in vacuum.

Comparatively high current strengths in the radiating elements are necessary for achieving a higher directivity for a given size or to achieve a miniaturization of the antenna for a given directivity. The high ohmic losses involved in this render the operation of such an antenna very inefficient.

A further possibility for improving the directivity is described in WO 99/17396. This publication discloses phased array antennas for communication with satellites, in which the radiating individual elements are arranged on curved, for example hemispherical surfaces. The directivity attained with such surfaces, however, is comparatively small. In addition, the manufacture of these antennas is comparatively expensive.

The invention accordingly has for its object to provide a phased array antenna of the kind mentioned in the opening paragraph with which a substantially higher antenna gain can be achieved in a desired radiation direction.

Furthermore, a phased array antenna is to be provided which renders possible in particular a wireless interlinking in a radio network of a plurality of arrangements and devices in a simple manner.

Finally, a phased array antenna is to be provided which is as small as possible, so that it can be integrated into mobile devices such as, for example, mobile telephones.

This object is achieved by means of a phased array antenna of the kind mentioned in the opening paragraph which is characterized, according to claim 1, in that the radiator elements are each aligned in dependence on their position in the array for achieving a current distribution in the antenna as determined for a desired antenna characteristic.

This opens the possibility, not only of adjusting the amplitudes and phases of the currents in the individual radiator elements, as is usual in phased array antennas, but also of using the directions of these currents as parameters for optimizing the antenna characteristic.

A radiator element may then be, for example, a strip conductor whose longitudinal dimension is aligned, or may be formed by a number of individual point-shaped radiation sources, for example arranged in a row, which are electrically joined together into a radiator element by means of a supply network.

A particular advantage of this solution is that such an antenna can be very strongly miniaturized without substantially detracting from its efficiency. It may also be used for a wireless interlinking of a plurality of arrangements and devices in a radio network thanks to its good directivity combined with small dimensions.

The dependent claims relate to advantageous further embodiments of the invention.

The embodiment defined in claim 2 maximizes the antenna gain in a given spatial direction while taking into account the ohmic losses in the antenna.

The embodiments defined in claims 3, 4, and 5 can be manufactured in a comparatively simple and integrated manner, while claim 6 relates to an advantageous dimensioning.

The embodiment of claim 7, finally, renders it possible to achieve practically any desired antenna characteristic.

Further particulars, characteristics, and advantages of the invention will become apparent from the ensuing description of a preferred embodiment which is given with reference to the drawing, in which.

Figure 1:
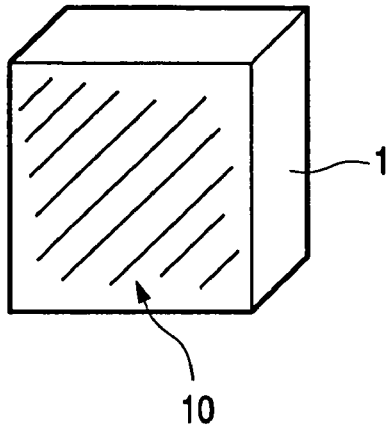
FIG. 1 is a diagrammatic overall view of an antenna according to a first embodiment of the invention.

FIG. 1 shows an embodiment of the antenna which is formed by a dielectric substrate 1 with an array 10 of individual radiator elements on at least one side of the substrate. The shape of the substrate 1 may be any shape desired and is chosen in accordance with the construction into which it is to be incorporated.

Figure 2:
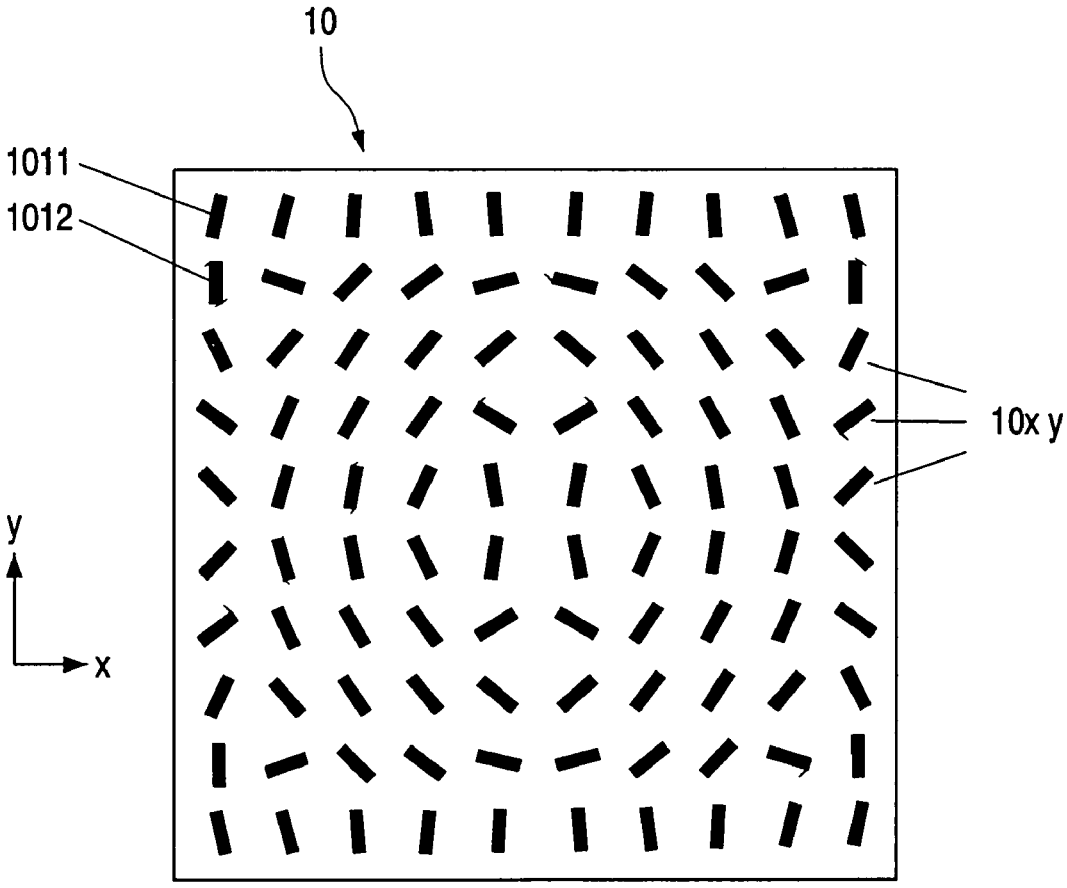
FIG. 2 shows the spatial arrangement and alignment of the radiator elements of such an antenna.

FIG. 2 shows the array 10 on an enlarged scale. The array is formed by a two-dimensional, substantially quadratic arrangement of ten times ten individual, substantially rectangular radiator elements 10xy ($1 \leqq x \leqq 10$; $1 \leqq y \leqq 10$). Each array has an edge length of approximately $\lambda/2$. The electrical conductivity of the radiator elements substantially corresponds to that of copper.

The radiator elements are formed in a known manner, for example each by a dipole or a strip conductor or the like. The direction in which each individual radiator element 10*xy* extends in the x/y plane is also apparent from this Figure. Since the current flows parallel to the longer side of the rectangle of a radiator element, each radiator element on account of its geometric orientation, which depends on its position in the array, determines the direction of the flow of current and thus the current distribution over the entire antenna surface. This arrangement has the advantage that a usual supply network can be used for supplying the antenna, with which network in addition the amplitudes and phases of the currents in the individual radiator elements are adjusted in a known manner.

Alternatively, the individual radiator elements may have substantially equal side lengths with a dimension of, for example, approximately $\lambda/40$ by $\lambda/40$.

Figure 3:
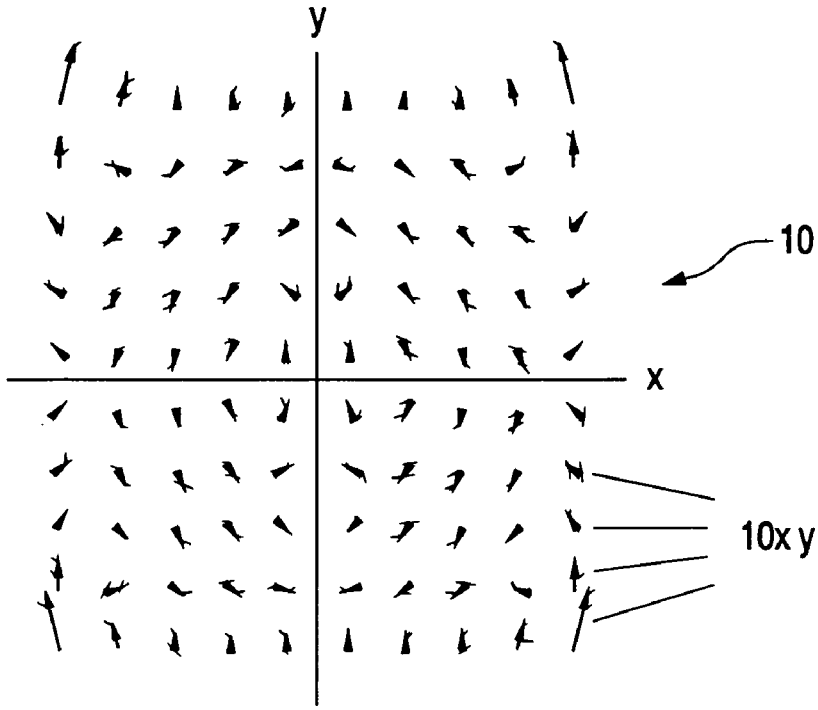
FIG. 3 shows the current directions and the current density amplitudes in the radiator elements.

FIG. 3 symbolically shows the radiator elements 10*xy* for the two-dimensional antenna array designed for an operating frequency of approximately 1 GHz, where the current directions are indicated by the directions of the arrow points and the current density amplitude is indicated by the length of the respective arrow. It is apparent from this picture that the current density amplitudes are particularly high in the radiator elements situated at the edges of the array.

An essential feature of the phased array antenna according to the invention is, therefore, that not only the amplitudes and phases, but also the directions of the currents in the individual radiator elements are defined, and that thus the current distribution throughout the entire antenna is adjusted in a defined manner. This achieves a considerable increase in the efficiency for a given, i.e. unchanged size of the antenna. It was surprisingly found in particular that the antenna according to the invention not only has a high directivity, but also can still be operated efficiently at very small dimensions, so that a miniaturization of a directional antenna is possible to a hitherto unparalleled degree for an accompanying high efficiency.

The radiator elements are aligned with their current directions such that a current distribution is achieved over the antenna in which the antenna gain is maximized in a definable spatial direction, taking into account the ohmic losses in the antenna. The antenna gain here is defined as the ratio of the power radiated in the desired direction to the sum of the total power radiated and the ohmic power losses.

The determination of the directions of the currents in the radiator elements, and thus the current distribution in the antenna structure are based on the following particular considerations: let us assume a finite antenna volume V and a given observation direction $\vec{e}_r$. That current density vector field in the antenna volume V is sought which leads to a maximum radiation in the desired observation direction in relation to the entire power fed into the antenna, i.e. to a maximum gain in this direction.

In the following text, $P_{rad}(\vec{e}_r)$ denotes the power radiated in the direction $\vec{e}_r$, $P_{rad}^{tot}$ denotes the total of the radiated power defined as $P_{rad}^{tot}=\int d\Omega P_{rad}(\vec{e}_r)$, and $$P_{ohm} = 1/2\sigma \int_V d^3x\, \vec{J}^*(\vec{x})\vec{J}(\vec{x})$$

denotes the ohmic power losses, where the parameter $\sigma$ denotes the conductivity.

Maximizing the gain $G(\vec{e}_r)=4\pi P_{rad}(\vec{e}_r)/(P_{rad}^{tot}+P_{ohm})$ as a function of the current density vector field leads to the following integral equation of the Fredholm type:

$$\int_V d^3x_2 M(\vec{x}_1,\vec{x}_2)\vec{J}(\vec{x}_2)+\xi\vec{J}(\vec{x}_1) = \rho\, e^{ik\vec{e}_r\vec{x}_1}\int_v d^3x_2\left(\vec{J}(\vec{x}_2)-\vec{e}_r\left(\vec{J}(\vec{x}_2)\vec{e}_r\right)\right)e^{-ik\vec{e}_r\vec{x}_2}$$

The parameter $\xi$ here is in three dimensions in accordance with $\xi=4\pi c/\omega^2\mu\sigma$, and the integral core is defined as $$M(\vec{x}_1,\vec{x}_2)=\{3(\sin(v)-v\cos(v))/v^3-\sin(v)/v\}1/v^2|\vec{v}\rangle\langle\vec{v}|+\{\sin(v)/v-(\sin(v)-v\cos(v))/v^3\}$$

with $\vec{v}=k(\vec{x}_1-\vec{x}_2)$.

Solving the integral equation yields that current distribution over the antenna structure which maximizes the gain in the given spatial direction $\vec{e}_r$ for a given antenna volume V.

Figure 5:
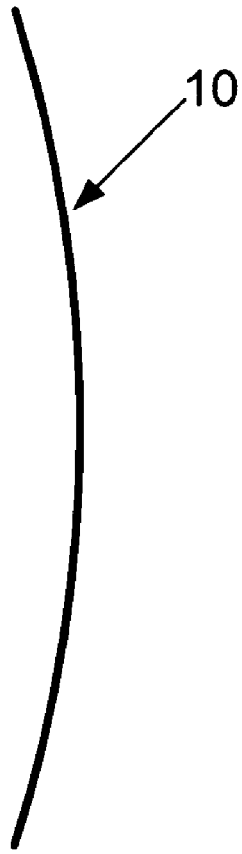
FIG. 5 is a cross-sectional view of an antenna according to a second embodiment of the invention.

It should additionally be noted that the integral equation itself can only be exactly solved in general in those cases in which the surface in which the current is to flow becomes comparatively simple, for example a spherical surface 10 as shown in FIG. 5. In most other cases, accordingly, one has to take recourse to approximation processes which finally reduce the infinite-dimensional problem of the determination of a continuous current distribution to a finite-dimensional problem. The approximation made for this purpose in the above case assumes that the current density in the individual radiator elements is constant. It is possible, however, to calculate more exactly and also to allow for a spatial dependence of the current on a radiator element. If the approximation of a constant current density in a respective radiator element is not sufficient in certain cases, a Fourier development may be implemented for the respective current densities, which breaks off at a certain order.

In the embodiment of the antenna shown in FIG. 2 with an array of spatially aligned radiator elements, the current density amplitude and the phase are adjusted for the individual radiator elements by means of a suitable supply network. The spatial alignment of the individual radiator elements as well as the current density amplitudes and phases thereof are determined by means of the equations given above so as to determine the optimum current density, with the object of obtaining a maximum gain in a desired direction. It is essential here that the spatial alignment of the individual elements of the antenna array should renders possible a further miniaturization while the efficiency remains the same.

Characteristic of the resulting alignment of the radiators as well as the current density amplitudes and phases thereof is the fact that the radiator elements are excited with the same phase and are spatially aligned only within the plane of the array (x/y plane) for the process of maximizing the gain in the symmetry direction perpendicular to the plane of the array (z-axis). This simplifies the manufacture of the array through the application of metallizations on a planar surface of the dielectric substrate 1. It is furthermore typical of the optimum excitation resulting in the radiator elements that comparatively high current density amplitudes occur at the edges of the array region.

In addition, the resonant length of the individual radiator elements can be reduced through the provision of the radiator elements on a dielectric substrate with a sufficiently high dielectric permeability, so that a resonant excitation of the array is possible by means of a suitable supply network.

Figure 4:
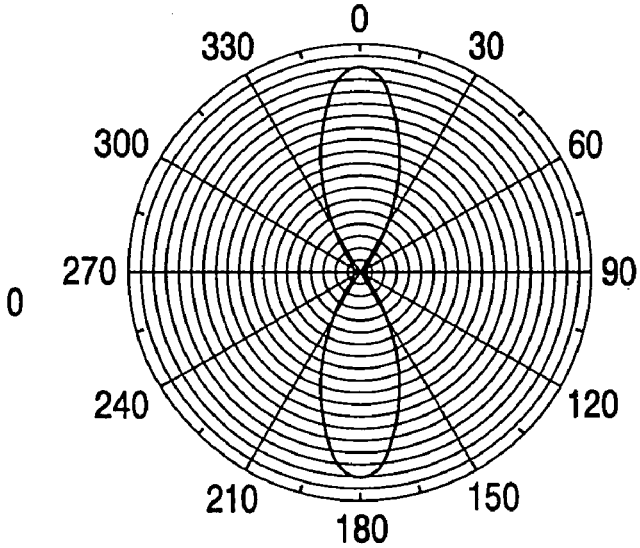
FIG. 4 is a directional diagram of a gain characteristic of the antenna shown in FIG. 2.

FIG. 4 shows a polar directional diagram of the gain in the z-plane, measured with an antenna having the spatial alignment shown in FIG. 2 and an excitation of the individual radiator elements. The outer circle here denotes a gain by a factor 10.

The gain is maximized in a direction perpendicular to the array (z-plane) with this alignment and with these current density amplitudes. A maximum gain G of 8.6 and a directivity D of 8.9 with an efficiency of 96% were achieved here. Compared with the directivity D of a two-dimensional array of the same edge length and the same excitation, calculated in accordance with the formula $D=8.83\times\text{area}/\lambda^2$, an increase in directivity by more than a factor 4 is found for the antenna according to the invention.

As is apparent from the Figure, the radiation of maximum gain takes place in the directions 0 and 180°, i.e. both in the (+z) and in the (−z) directions. The application of a reflector plate in the x/y plane parallel to the two-dimensional array at a distance of, for example, $\lambda/4$, however, renders it possible to achieve a radiation with maximum gain in substantially only one spatial direction.

If a maximum antenna gain is desired in another direction, which need not be necessarily perpendicular to the plane of the radiator elements, i.e. not in the z-plane, a suitable excitation of the individual radiator elements may be calculated by the method mentioned above, with different phases and with a spatial alignment of the radiator elements which need not necessarily be limited to the x/y plane. In this manner, a direct radiation in a preferred direction may be achieved also without a reflector plate, given a suitable alignment and choice of phase.

The invention claimed is:

1. A phased array antenna including a plurality of radiator elements, said radiator elements being aligned in dependence on their respective positions in the array for achieving a current distribution in the antenna as determined for a desired antenna characteristic, being spatially aligned only within a plane of the array; and being aligned such that gain of the antenna is maximized, said gain being defined as a ratio of the power radiated in a desired direction to the sum of the total power radiated and the ohmic power losses.

2. A phased array antenna as claimed in claim 1, characterized in that the radiator elements are provided on a dielectric substrate and are capable of resonant excitation.

3. A phased array antenna as claimed in claim 2, characterized in that the radiator elements are each formed by a strip conductor.

4. A phased array antenna as claimed in claim 2, characterized in that the individual radiator elements are of a substantially rectangular shape.

5. A phased array antenna as claimed in claim 4, characterized in that the individual radiator elements have side length dimensions of approximately $\lambda/40$ by $\lambda/40$.

6. A phased array antenna as claimed in claim 4, characterized in that the individual radiator elements have a side length dimension of approximately $\lambda/2$.

7. A phased array antenna as claimed in claim 1, characterized in that the plane of the array is flat.

8. A phased array antenna as claimed in claim 1, characterized in that the plane of the array is curved.

* * * * *